US005517917A

United States Patent [19]

Hartung et al.

[11] Patent Number: 5,517,917

[45] Date of Patent: May 21, 1996

[54] METHOD AND APPARATUS FOR METERING LIQUID MEDIA IN OFFSET PRINTING MACHINES, PREFERABLY FOR VARNISHING UNITS

[75] Inventors: Georg Hartung, Seligenstadt; Manfred Herold, Hainburg; Ulrich Jung, Limburg, all of Germany

[73] Assignee: MAN Roland Druckmaschinen AG, Germany

[21] Appl. No.: 319,989

[22] Filed: Oct. 7, 1994

[30] Foreign Application Priority Data

Oct. 13, 1993 [DE] Germany ..... 43 34 803.3

[51] Int. Cl.[6] ..... B41F 31/06; B41F 31/10

[52] U.S. Cl. ..... 101/350; 101/363

[58] Field of Search ..... 101/363, 350, 101/364, 148, 144, 207–210, 349, 366; 118/258, 259, 261

[56] References Cited

U.S. PATENT DOCUMENTS

| | | | |
|---|---|---|---|
| 2,240,762 | 5/1941 | Dietrich | 101/363 X |
| 2,374,096 | 4/1945 | Heywood et al. | 101/350 |
| 4,308,796 | 1/1982 | Satterwhite | 101/143 |
| 5,003,876 | 4/1991 | Harrison et al. | 101/350 |
| 5,081,928 | 1/1992 | Harrison | 101/351 |

FOREIGN PATENT DOCUMENTS

| | | |
|---|---|---|
| 0071180A1 | 7/1982 | European Pat. Off. . |
| 3427898C1 | 7/1984 | Germany . |
| 3906648A1 | 10/1989 | Germany . |

*Primary Examiner*—J. Reed Fisher
*Attorney, Agent, or Firm*—Leydig, Voit & Mayer, Ltd.

[57] ABSTRACT

Method and apparatus for metering liquid media of different viscosity and preferably for metering liquid media for application to a printing carrier in varnishing units. In order to assure precise metering, exchangeable metering systems are assigned to a forme cylinder. If processing of low-viscosity media is required, a metering roller and an applicator roller of identical external diameter but different surface hardness are used. For the processing of higher-viscosity media, a chamber-type doctor with a screened applicator roller is used.

2 Claims, 2 Drawing Sheets

METHOD AND APPARATUS FOR METERING LIQUID MEDIA IN OFFSET PRINTING MACHINES, PREFERABLY FOR VARNISHING UNITS

BACKGROUND OF THE INVENTION

This invention relates to method and apparatus for metering liquid media of different viscosity in offset printing machines. The apparatus preferably serves to meter liquid media for application to a printing carrier in varnishing units. The apparatus is suitable for processing low-viscosity (≦50s outflow time 4 mm Becher) media such as dispersion varnish on an aqueous basis and is also suitable for processing higher-viscosity (>50s outflow time 4 mm Becher) media such as bronze/effect printing ink with a defined pigment proportion (e.g., gold varnish).

Various solutions are known for applying liquid media. According to DE 3 427 898 C1, the feed of the media to be applied takes place by means of a metering roller and an applicator roller by the squeeze roller principle, the liquid (e.g., varnish) being fed to the nip between the rollers by means of a tube via a wedge of varnish.

A chamber-type doctor of the type known from EP 0 071 180 A1 is essentially formed by a housing with side walls and by doctor blades attached to the housing. The doctor blades are supported on a screened applicator roller, and the liquid is transferred onto the applicator roller via the chamber thus formed. In this case, the chamber-type doctor is mounted pivotably in a holder arranged above the applicator roller and can be engaged against the applicator roller by an operating cylinder acting on the holder.

These solutions are disadvantageous in that they do not guarantee precise metering (generating a defined layer thickness) of the media to be applied with media of different viscosity. The known solutions thus cannot be used universally for applying the media used by various printing carriers.

An applicator unit for printing machines is known according to DE 3,906,648 A1 and is suitable for high-viscosity and low-viscosity media. In this case, the metering take place essentially by means of a profiled dip roller, a doctor blade, a transfer roller and smoothing rollers or by means of an applicator roller and a forme cylinder, provided with wells, with a doctor blade.

These designs are complex in construction, in particular when using smoothing rollers.

SUMMARY OF THE INVENTION

The general object of the present invention is to provide method and apparatus which eliminate the disadvantages mentioned.

A more detailed object of the invention is to achieve the foregoing by providing an exchangeable metering system which is used selectively depending upon the particular application. It permits rapid exchange of a metering roller and a chamber-type doctor in combination with a suitable applicator roller.

When processing the lower-viscosity media (≦50s outflow 4 mm Becher), a two-roller system is used, consisting of an applicator roller and a metering roller each having a different surface hardness. In this case, both rollers have an identical external diameter. Depending on the type of layer thickness desired on the forme cylinder, either roller can be used alternately as an applicator roller or as a metering roller. The roller with the higher surface hardness transfers the lesser layer thickness onto the forme cylinder by the principle of ink splitting. When processing higher-viscosity media (≦50s outflow 4 mm Becher), a chamber-type doctor and a screened applicator roller are used. Correct metering takes place due to a negatively inclined doctor blade of the chamber-type doctor and due to the screen structure of the applicator roller. Changing the metered quantity is possible by replacing the screened applicator roller with a roller having a different screen structure.

The advantage of this solution is that a precise layer thickness for media with a lower and higher viscosity range is assured by the selective exchange of the metering systems. A further advantage is that the metering roller and the applicator roller can be exchanged with one another when processing low-viscosity media. The different surface hardness allows a more variable metering range (for lower viscosity) without need of using the chamber-type doctor.

The apparatus can be arranged ahead of the first printing unit of an-offset printing machine for print finishing (e.g., varnishing or applying a cover layer), arranged between the printing units, or arranged after the printing units. The solution according to the invention is suitable for spot varnishing (cut-out varnishing) and for full-surface varnishing. Further finishing apparatus can likewise be arranged ahead of or after the apparatus according to the invention (e.g., a further varnishing unit for full-surface varnishing or a laminating or embossing device).

By means of the apparatus according to the invention, a larger range of viscosities can be metered accurately in the desired layer thickness on an applicator roller.

These and other objects and advantages of the invention will become more apparent from the following detailed description when taken in conjunction with the accompanying drawings.

Figure 1:
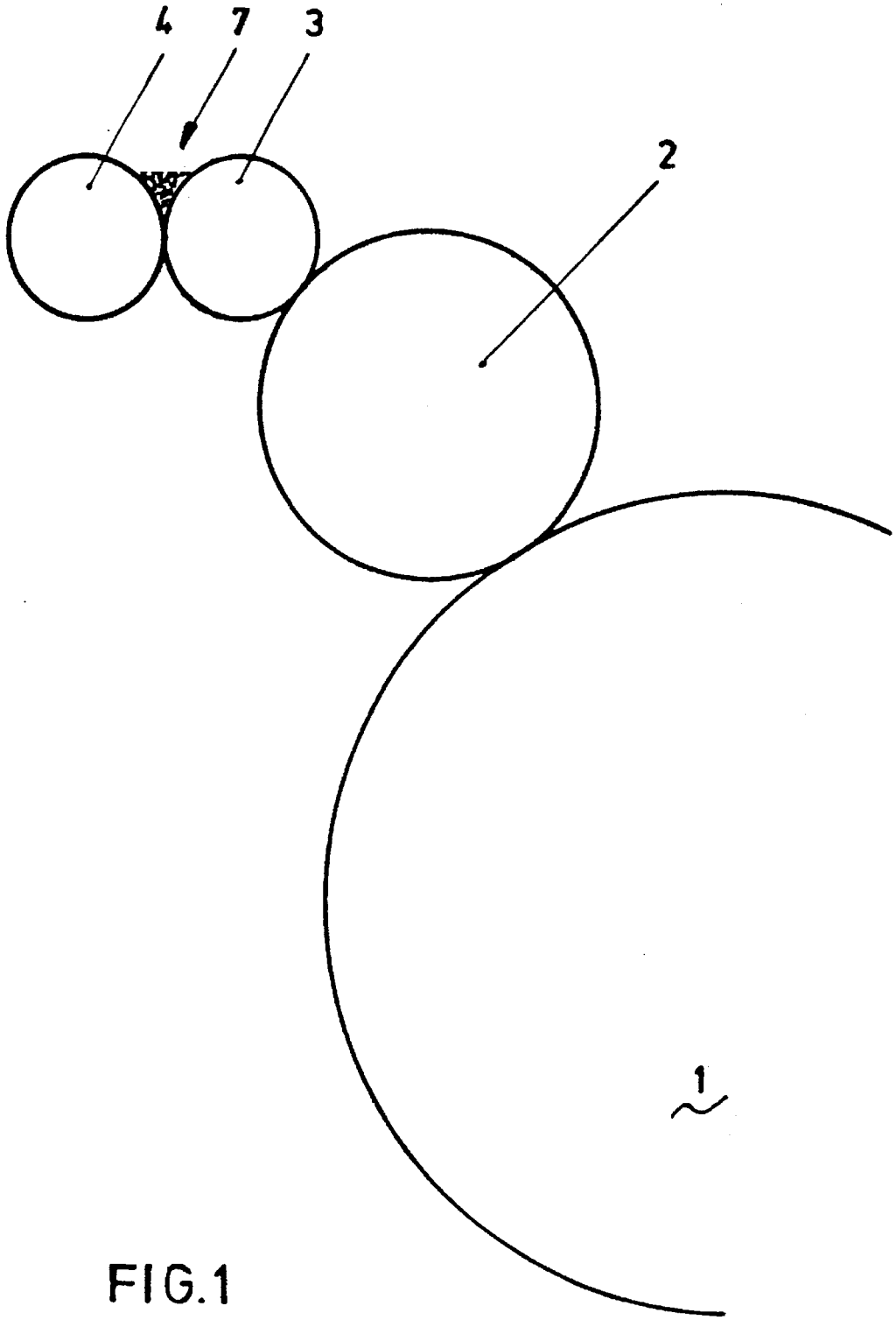
FIG. 1 is a schematic view of the metering apparatus for low-viscosity media.

While the invention is susceptible of various modifications and alternative constructions, a certain illustrated embodiment hereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

In an offset printing machine, the apparatus according to the invention is arranged after the last printing unit and serves for the in-line varnishing of printing carriers. The device consists of a back pressure or sheet-conveying cylinder 1, to which a forme cylinder 2 with an attached transfer forme is assigned. The forme cylinder 2 is in contact with an applicator roller 3 on which the varnish to be processed is metered. For metering low-viscosity varnishes (≦50s outflow time 4 mm Becher), the applicator roller 3 is in contact with a metering roller 4. The metering roller 4 and the applicator roller 3 have, above the roller nip 7, a feed tube for introducing the varnish to be processed into the nip. Both rollers 3, 4 have the same external diameter, but a different surface hardness. Thus, the applicator roller 3 is constructed with a harder surface (e.g., steel) and the metering roller 4 is constructed with a softer surface (e.g., with an elastomer covering). The rollers 3, 4 are mutually exchangeable so that the softer metering roller 4 can also carry out the function of the applicator roller, and the harder applicator roller 3 takes on the function of the metering roller. Depending on the requirements placed on the layer thickness, a smaller layer thickness is transferred to the forme cylinder 2 by the principle of ink splitting by using the harder applicator roller 3 and, when using the softer metering roller 4 in the function of the applicator roller, a greater layer thickness is transferred to the forme cylinder 2 with a defined engagement force.

Figure 2:
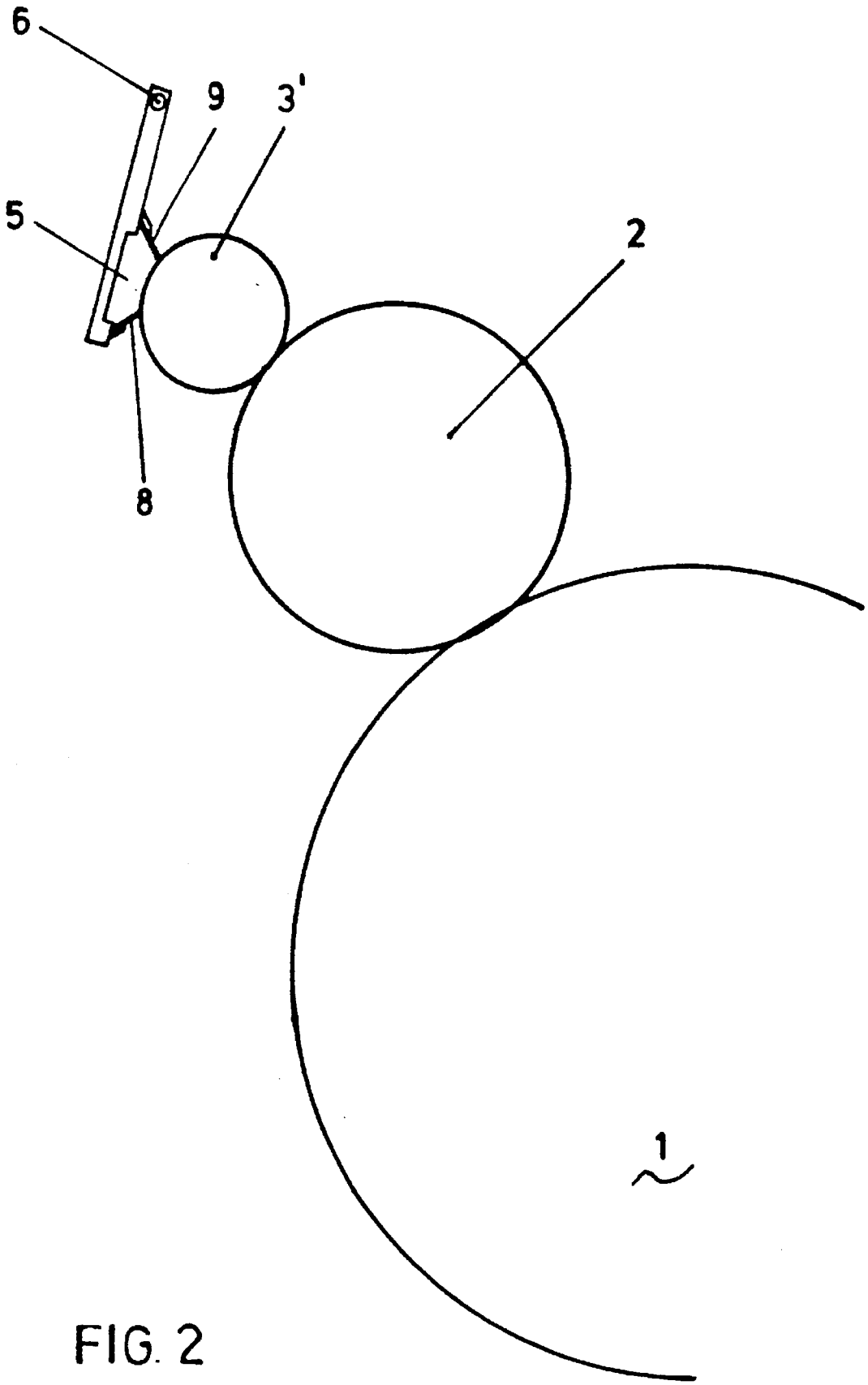
FIG. 2 is a schematic view of the metering apparatus for higher-viscosity media.

For metering higher-viscosity varnishes (>50s outflow time 4 mm Becher), the applicator roller 3 and the metering roller 4 are replaced with a screened applicator roller 3' (e.g., a ceramic roller) and by a chamber-type doctor 5 as shown in FIG. 2. The chamber-type doctor 5 has a housing which is arranged rotatably on a swivel bearing 6 and is supported with doctor blades 8, 9 on the circumference of the screened applicator roller 3'. The doctor blade 9 acts as a positively inclined terminating doctor and seals off the chamber to the applicator roller 3'. The doctor blade 8 meters as a negatively inclined working doctor. The housing of the chamber-type doctor 5 is held on both sides so as to be rotatable in each case in the swivel bearing 6 arranged on side frames and can be engaged with the applicator roller 3'. The chamber-type doctor 5 has a device for feeding and removing the medium to be processed, which device need not be described in greater detail here.

The mode of operation of the apparatus is as follows:

If a low-viscosity varnish is to be processed, the metering roller 4 and the applicator roller 3 are assigned to the forme cylinder 2. In this case, the applicator roller 3 with the greater surface hardness can have a smooth or screened surface, whereas the metering roller 4 is provided with a softer surface such as an elastomer covering. The low-viscosity varnish to be processed is conveyed into the roller nip 7 via the feed line so that a wedge of varnish is formed. The metering roller 4 can be engaged with the applicator roller 3. The metering takes place by the squeeze roller principle, the applicator roller 3 conveying the varnish to the forme cylinder 2 which transfers the varnish onto the printing carrier in conjunction with the back pressure cylinder 1.

Depending on the requirement, the softer metering roller 4 can also take on the function of the applicator roller 3 since both rollers 3, 4 are mutually exchangeable. The softer metering roller 4 as the applicator roller then conveys more varnish to the forme cylinder 2 than the harder applicator roller 3. When the varnish has passed through the roller nip 7, the rollers 3, 4 have different layer thicknesses at a defined engagement force due to the different surface hardness and the ink splitting. The applicator roller 3 bears the smaller layer thickness as a result of the harder covering. The defined engagement force can be adjusted between the two rollers 3, 4 and allows flexible adjustment of the quantity of varnish to be metered. By exchanging the two rollers 3, 4, the metering region can be widened towards the forme cylinder 2.

If a higher-viscosity varnish is to be processed, the varnish feed tube above the roller nip 7 is removed and the metering roller 4 and the applicator roller 3 are replaced by the chamber-type doctor 5 and the screened applicator roller 3', the chamber-type doctor being held by the swivel bearing 6. The varnish is now metered by the negatively inclined working doctor blade 8 and by the screen structure of the applicator roller 3'. Changing the quantity of varnish which can be metered is possible by replacing the screened applicator roller 3' with an applicator roller having a different screen structure.

We claim:

1. A method for metering liquid media of different viscosities in an offset printing machine having a varnishing unit with a back pressure cylinder and a forme cylinder, said method comprising the steps of:

(A) providing a first roller having a given diameter and a first surface hardness;

(B) providing a second roller having the given diameter and a surface hardness greater than the first surface;

(C) determining the thickness of low-viscosity media to be applied to the forme cylinder;

(D) selectively contacting the second roller to the forme cylinder at a predetermined location and contacting the first roller to the second roller when a relatively thin coating of low-viscosity media is desired;

(E) selectively contacting the first roller to the forme cylinder at a predetermined location, and contacting the second roller to the first roller when a relatively thick coating of low-viscosity media is desired;

(F) introducing relatively low viscosity media into the nip between the first roller and the second roller for application of the media to the forme cylinder by the roller selectively contacting the forme cylinder according to steps (D) and (E);

(G) removing the first roller from contact with the second roller and removing the roller selectively contacting the forme cylinder from contact with the forme cylinder;

(H) contacting the forme cylinder with a screened applicator roller at approximately said predetermined location; and (I) using a chamber-type doctor to meter relatively high viscosity media to the screened applicator roller for application of the media to the forme cylinder.

2. Apparatus for metering liquid media in an offset printing machine having a varnishing unit with a back pressure cylinder and a forme cylinder, said apparatus comprising two exchangeable metering systems for metering media of different viscosity to the forme cylinder, one of said systems comprising first and second exchangeable rollers with identical external diameters the first roller having a surface hardness, and the second roller having a surface hardness greater than the first surface hardness, said first and second rollers serving as an applicator roller and a metering roller for the forme cylinder to meter and apply media having a relatively low viscosity, the first and second rollers being exchangeable between a thin layer orientation, wherein the second roller contacts the forme cylinder and the first roller contacts the second roller for metering a relatively thin layer of the relatively thin low viscosity media to the forme cylinder, and a thick layer orientation, wherein the first roller contacts the forme cylinder and the second roller contacts the first roller for metering a relatively thick layer of the relatively low viscosity media to the forme cylinder, the other of said systems comprising a chamber-type doctor and a screened applicator roller serving to meter and apply media having a relatively high viscosity to the forme cylinder.

* * * * *